United States Patent [19]

Krawagna

[11] 4,106,772

[45] Aug. 15, 1978

[54] GOLF SWING PRACTICE BASE

[75] Inventor: Alois Krawagna, Toronto, Canada

[73] Assignee: Sports Technology Inc., Toronto, Canada

[21] Appl. No.: 756,800

[22] Filed: Jan. 4, 1977

[51] Int. Cl.[2] ..... A63B 69/36

[52] U.S. Cl. ..... 273/186 R; 273/183 A; 273/176 J; 273/195 R

[58] Field of Search ..... 273/186 R, 186 B, 186 C, 273/183 A, 195 R, 195 A, 195 B, 176 N, 203

[56] References Cited

U.S. PATENT DOCUMENTS

| | | | |
|---|---|---|---|
| 1,783,211 | 12/1930 | Baldwin | 273/183 A |
| 2,124,123 | 7/1938 | Rosengarten | 273/195 A |
| 2,786,683 | 3/1957 | Shapiro | 273/183 A |
| 3,112,111 | 11/1963 | Bennett | 273/203 |
| 3,113,780 | 12/1963 | Livingstone | 273/186 R |
| 3,143,350 | 8/1964 | Lester | 273/195 A |
| 3,194,565 | 7/1965 | Schroer | 273/186 R |
| 3,246,898 | 4/1966 | Shoaf | 273/186 C |
| 3,599,982 | 8/1971 | Elesh | 273/195 A |
| 3,741,550 | 6/1973 | Landures | 273/186 R |

FOREIGN PATENT DOCUMENTS

| | | | |
|---|---|---|---|
| 271,456 | 6/1963 | Australia | 273/195 R |
| 383,767 | 11/1932 | United Kingdom | 273/186 R |

*Primary Examiner*—George J. Marlo
*Attorney, Agent, or Firm*—Finnegan, Henderson, Farabow & Garrett

[57] ABSTRACT

A resilient golf swing practice base having a preferred swing path; an upper surface with ribbing aligned parallel to the swing path to provide a visual guide for the path; a bottom surface with ribbing aligned transverse to the path to engage the ground and inhibit movement when the base is struck along the preferred path, the bottom and top ribbing together providing the resiliency, the bottom ribbing being of graduated height to produce a convex profile to the upper surface along the preferred path. The shoulders of an aperture positioned in the base at the maximum elevation in the convex profile support the golf ball.

10 Claims, 5 Drawing Figures

Fig. 1
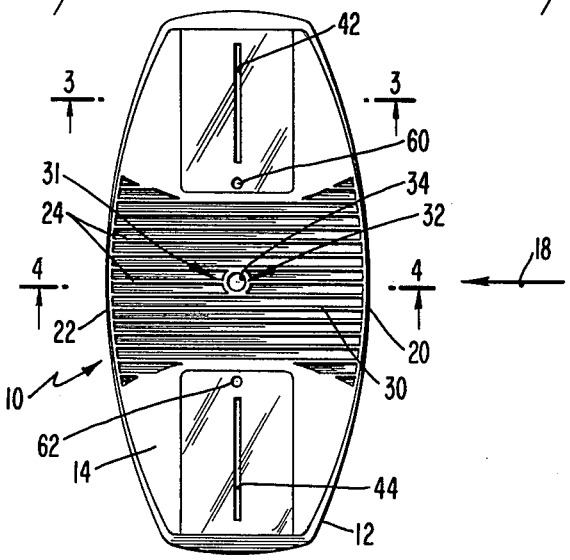
Fig. 2
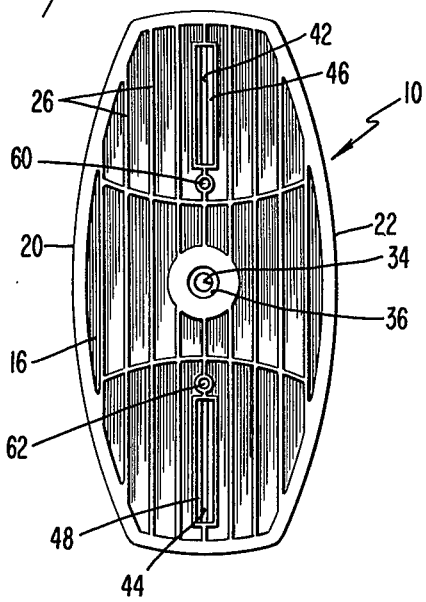
Fig. 3
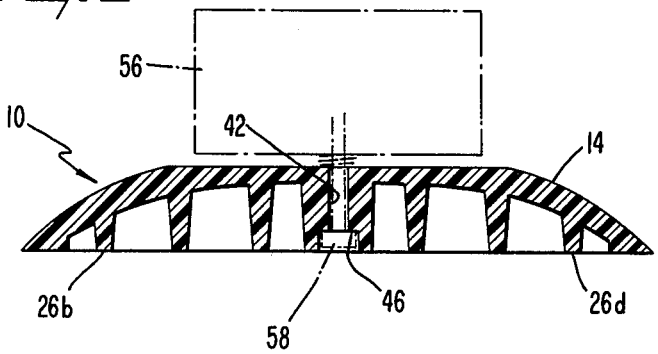
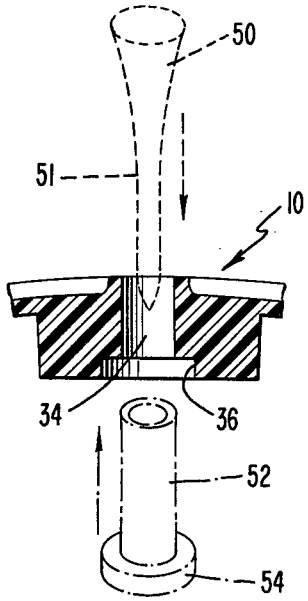
Fig. 5
Fig. 4
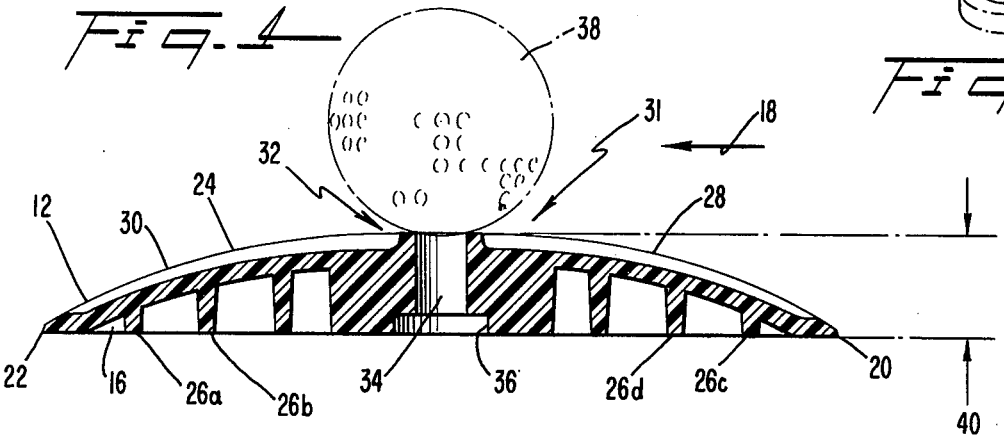

GOLF SWING PRACTICE BASE

BACKGROUND OF THE INVENTION

1. Field of the Invention

This invention relates to a golf swing practice device. More particularly, this invention relates to a base for supporting a golf ball in an appropriate position for striking with the head of either an iron or a wood and also as a base or support for a golf swing monitor teaching device of the type shown in U.S. Pat. No. 3,992,012.

2. Description of the Prior Art

The use of special bases from which a golf ball is hit during practice is well known in the art. For instance, bristle mats, similar to those used for door mats, have long been employed as such a base. Numerous variations of the bristle mats have also been developed and are primarily designed to hold the golf ball in an elevated position above a planar member on some type of resilient grass-like projections so that the ball may be picked from its position without driving the club head into either the planar member or the sub-support beneath the planar member.

These prior art bases are beset with various problems. For instance, some bases wear out very rapidly under repeated use particularly when struck with the sharp edges of an iron. Others fail to provide the feel of turf or are so constructed that the golfer is prevented from taking his full normal swing for fear of receiving a shock from either the planar member or its underlying sub-support.

Attempts to provide for wear resistant practice bases have resulted in relatively stiff bases better suited for practice with woods than irons. Golf swing practice bases of this type typically utilize insertable tees to raise the golf ball above the surface of the base.

Although an iron can be used to hit golf balls from a tee the fairway iron and wood shot is hit with the golf ball lying directly on the turf and involves a swinging movement of the club that causes the head to hit down into the turf to produce a correct shot.

The relatively stiff, non-resilient construction of such practice mats can cause undue shock to the wrist and arm of a golfer were he to attempt to strike the ball in the manner of a fairway iron or wood shot. Furthermore, the anticipation of such a shock causes a golfer to vary his swing thus reducing the benefits of such practice.

Other golf swing practice mats attempt to provide a base with a resilient surface for use when practicing with irons. Although bases with upward projections and flexible members seek to simulate the feel of natural turf during the golf swing, durability and expense of such bases sometimes results in failure.

The base of the present invention can be used as a golf swing practice base for both woods and irons. It is durable and inexpensive to manufacture and provides the golfer with a turf-like feel when practicing fairway iron and wood shots. Significantly, the convex upper surface of the base of the present invention coupled with the resilient structure provided by the unique ribbing produces a turf-like feeling and does not give the golfer the feeling of swinging down into a rigid base or sub-base. The golfer is therefore able to take his full normal swing and actually practice the same type of swing that would be used on the fairway.

Finally, it is especially beneficial to the practicing golfer that the base of the present invention can be used with a golf swing monitor device which advises the golfer of the correctness of his swing. The monitoring device utilized on the base can be of the nature of that shown in U.S. Pat. No. 3,992,012.

SUMMARY OF THE INVENTION

Additional advantages of the present invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing advantages in accordance with the purpose of the invention, as embodied and broadly described herein, the base for supporting a golf ball to be struck during the swinging movement of the head of a golf club comprises an upper surface defining a generally convex profile and means to permit deformation of that profile downwardly and return to the original convex profile having ribbing oriented substantially parallel to the direction of a preferred golf club head swing path, the top ribbing providing a visual guide to the direction of the preferred golf club head swing path, the upper surface of the top ribbing forming the generally convex profile along the golf club head swing path, a bottom surface having ribbing angularly oriented relative to the top ribbing to provide for engagement with the ground to inhibit the movement of the base when struck with a club head, the bottom and top ribbing interacting to provide the desired resiliency; and means for supporting the golf ball, said means being positioned in the golf club head swing path substantially at the point of maximum elevation on said convex profile.

As herein embodied, the convex profile is provided by reducing the height of the bottom ribbing forwardly and rearwardly from the ball support means, the bottom ribbing is oriented substantially perpendicular to the direction of said top ribbing, and the ball support means includes an aperture in the base at the support means position, the golf ball being supported by the shoulders of the aperture. Preferably, the thickness of the base at the position of the aperture is such as to support a golf ball at a height above the ground approximately equal to that of a ball resting on the manicured turf of a fairway.

It is also preferred that the base also may be used both with conventional tees and with a removable golf ball support element, the aperture being sized to pass the stems of conventional tees and to engage the support element.

It is also preferred that the base may be used in a golf swing monitor teaching device, the device including a pair of sensing means for determining deviations in the trajectory of a club head from the preferred path, wherein the base further comprises a pair of slots for slidingly mounting the pair of sensing means, each of the slots being oriented perpendicular to the preferred path and disposed on opposite sides of the path, the slots permitting the sensing means to be moved toward or away from the preferred path.

The accompanying drawing, which is incorporated in, and constitutes a part of, this specification, illustrates one embodiment of the invention and, together with a description, serves to explain the principles of the invention.

BRIEF DESCRIPTION OF THE DRAWING

FIG. 1 is a top view of the golf swing practice base of the present invention;

FIG. 2 is a bottom view of the base shown in FIG. 1;

FIG. 3 is a sectional view taken along the lines 3—3 of FIG. 1;

FIG. 4 is a sectional view taken along the lines 4—4 of FIG. 1; and

FIG. 5 is a detail of a part of the base shown in FIG. 1.

DESCRIPTION OF THE PREFERRED EMBODIMENT

Reference will now be made in detail to the present preferred embodiment of the invention, an example of which is illustrated in the Figures of the accompanying drawing.

Referring now to FIGS. 1 and 2, there is provided a base 10 for supporting a golf ball to be hit therefrom. The base 10 is intended for use when practicing with either irons and woods. Base 10 is particularly useful for practicing in locations lacking good quality turf or where it is desirable to prevent the grass cover from being destroyed. The ball may be hit directly from base 10 with a wood or iron, or conventional tees or tubular practice tees such as found on driving range platforms may be utilized in conjunction with base 10. An example of such tubular practice tees can be found in U.S. Pat. No. 3,599,982 to Elesh.

Base 10 is a generally mat-like structure and is adapted to rest horizontally on the ground or other support. It is intended that base 10 be fabricated from any of the easily moldable, wear-resistant synthetic plastic materials such as polyurethane. TEXIN 355D supplied by Bayer Chemical Co. was found to be an acceptable material. However, a suitable base also could be constructed using the natural rubbers or other flexible materials and the present choice of material is not intended to limit in any way the scope of the invention to be described hereinafter.

Referring to FIGS. 1 and 2, base 10 has a upper surface 14 and a bottom surface 16, the surfaces being defined when the base is resting on the ground or other support. As can best be seen from FIG. 1, base 10 has a preferred golf club head swing path 18 across the top surface 14. Preferred path 18 begins at a leading edge 20 and terminates at a trailing edge 22 of the base. The edges 20 and 22 are so designated to reflect the fact that the golf club head first "sees" edge 20 during the head's travel across base 10 along path 18.

In accordance with the invention, ribbing 24 is provided on the top surface 14 of base 10 in the vicinity of preferred golf club head swing path 18 and extends from leading edge 20 to trailing edge 22. Top ribbing 24 is oriented substantially parallel to path 18 and provides a visual guide to the golfer to assist him in aligning his stance and golf swing to preferred path 18.

The cross-sectional shape of base 10 along preferred path 18, as defined by the upper surface of the top ribbing 24, is generally convex as depicted in FIG. 4 by arc 28,30. Arc 28,30 begins at leading edge 20 at ground level, rises to a point of maximum elevation and then terminates at trailing edge 22, also at ground level.

In accordance with the invention, ribbing 26 also is provided on the bottom surface 16 of base 10. The direction of bottom ribbing 26 is such that the individual ribs are angularly oriented relative to the top ribs 24 and to the preferred path 18. This angular orientation of bottom ribbing 26 acts to provide engagement with the ground or other support to inhibit the movement of base 10 when struck with a club head. Other orientations of the bottom ribbing are possible to inhibit such movement.

During an iron or fairway wood practice swing, and also during a missed tee shot, the club head contacts the surface underlying the golf ball with a force of substantial magnitude that were such angularly oriented bottom ribbing 26 not provided, base 10 would tend to slide in the direction of the swing. The cross-sectional shape of the individual bottom ribs 26 can be made to enhance this anchoring function. For instance, the sharp-edged inverted-trapezoid shape shown in FIG. 4 for rib **26*a*** was found to provide increased traction.

It is intended that bottom ribbing 26 dynamically interact with top ribbing 24 when top surface 14 is struck by the club head during the course of a swing in order to impart a resiliency to base 10. The convex profile of the base 10 deforms downwardly when struck with the club head and then returns to the original shape. Because of the convex profile, the club head slides easily off the base 10 after deformation. Such frictional engagement continues between the base and the head, after the head moves downwardly through the ball and deforms the base, as it slides into the open on the rearward slope of the convex profile. This deformation of the base and continuing frictional engagement produces a feeling of striking turf when hitting the ball. This controlled deformation and resiliency is of critical importance in minimizing shock to the golfer's wrists and arms during an iron or fairway wood shot and also during a missed tee shot when the base 10 is accidentally struck.

As here embodied, the convex profile depicted by arc 28,30 is provided by graduating the height of the individual ribs of bottom ribbing 26 away from both leading edge 20 and trailing edge 22 with increasing height toward the center of swing path 18. As can best be seen in FIG. 4, adjacent bottom ribs **26*a* and 26*b* increase in height away from trailing edge 22, and ribs 26*c* and 26*d* graduate away from leading edge 20. Both leading edge 20 and trailing edge 22 are substantially flush with the surface of the ground. As a consequence, an area 31 is created in approximately the center of convexity of preferred path 18, which area 31 is the area of maximum resiliency of base 10**.

In accordance with the invention, and as best seen in FIG. 4, means 32 is provided in base 10 for supporting golf ball 38. The golf ball support means 32 is positioned in the area 31 of maximum resiliency, that is, approximately in the center of golf swing path 18 at the point of maximum elevation on the convex profile 28,30. By virtue of the convex profile 28,30, upper surface 14 has a downward slope from support weave 32 forwardly to leading edge 20 and also from support means 32 rearwardly to trailing edge 22. The resiliency of base 10 in the area 31 and the convex profile 28,30 contribute a "turf-like feel" during an iron shot and thereby maximizes the golfer's consistency in going from the base 10 to hitting a ball on natural turf to thereby strengthen his confidence.

As here embodied, golf ball support means 32 preferably includes an aperture 34 in base 10 in area 31. The diameter of aperture 34 is sized to permit golf ball 38 to be supported by the shoulders of aperture 34 at the top surface 14. Hence, the diameter of aperture 34 generally will be much less than the diameter of golf ball 38. However, and referring to FIG. 5, it is also preferred that the diameter of aperture 34 be large enough to pass the stem 51 of a conventional tee 50 and to engage a removable tubular golf ball support element 52 such as used on conventional driving range platforms. An aperture relief 36 also is provided for aperture 34 on the bottom surface 16 of the mat in order to receive the flaired end 54 typically utilized by such support elements.

As here embodied, and as best seen in FIG. 4, the overall height from the ground level to the peak of the convex arc 28,30 should be such as to allow support means 32 to support golf ball 38 at a height above the ground approximately equal to that of a ball resting on the manicured turf of a fairway. Controlling the height of support means 32 in this manner enables a golfer to make the transition from practice to the fairway without changing his grip or his stance to accommodate a different ball elevation.

As can best be seen in FIGS. 1–3, the base 10 also is intended for use in a golf swing monitor teaching device, such as the device shown in U.S. Pat. No. 3,992,012. This device includes a pair of sensing means for determining deviations in the trajectory of a club head from a preferred golf club head swing path. To enable the pair of sensing means to be mounted on the base 10, a pair of slots 42,44 is provided in base 10, one on each side of preferred path 18. Each of slots 42 and 44 is oriented substantially perpendicular to preferred path 18 and is adapted for slidingly mounting one of the sensing means. FIG. 3 shows schematically a single sensing means unit 56 mounted in slot 42 by means of spring-loaded, T-shaped clip 58, and this manner of mounting is commonly used. Preferably, slots 42 and 44 have an enlarged bottom portion to define a T-shaped cross-section and to provide shoulder abutments 46 and 48 to receive the heads of such spring-loaded, T-shaped clips.

The presence of slots 42 and 44 in base 10 should not be taken to restrict the use of base 10 solely as a base for a golf swing monitor or other teaching apparatus. Base 10 with or without slots 42 and 44 can be used alone as a surface for hitting both iron and wood shots. Base 10 also can be used without a golf ball 38 for practicing a swing or with any of the standard lightweight practice balls.

In areas where the ground or other support provides poor engagement with the bottom ribs 26, the base 10 may be secured to the ground or other support by pegs, stakes, nails, or the like. Such pegs may be located in openings 60 and 62 at the ends of the base 10 and driven into the ground or other support.

It will be apparent to those skilled in the art that various modifications and variations could be made in the golf swing practice base of this invention without departing from the scope and spirit thereof.

What is claimed is:

1. A resiliently deformable base for supporting a golf ball above a support to be struck during the swinging movement of the head of a golf club, the base providing a turf-like feel during the deformation accompanying a practice swing with an iron-type golf club, the base comprising (a) an upper surface having ribbing oriented substantially parallel to the direction of a preferred golf club head swing path, said top ribbing providing a visual guide to the direction of the preferred golf club head swing path, the upper surface of said top ribbing forming a convex profile along said golf club head swing path;

(b) a bottom surface having ribbing angularly oriented relative to said top ribbing to provide for engagement with the support to inhibit the movement of the base when struck with a club head, said bottom and top ribbing interacting to provide the desired deformation and resiliency, and (c) means for supporting the golf ball, said means being positioned in said golf club head swing path substantially at the point of maximum elevation on said convex profile, the curvature of said convex profile beginning substantially at the point of maximum elevation and smoothly varying both forwardly and rearwardly of said point along said preferred swing path and terminating substantially in the plane of the support at the respective edges of said base.

2. A base as recited in claim 1 wherein said bottom ribbing is oriented substantially perpendicular to the direction of said top ribbing.

3. The base as in claim 1 wherein said golf ball support means includes an aperture in the base at said support means position, the golf ball being supported by the shoulders of said aperture.

4. The base as in claim 3 wherein the thickness of said base at the position of said aperture is such as to support a golf ball at a height above the ground approximately equal to that of a ball resting on the manicured turf of a fairway.

5. The base as in claim 3 also for use both with conventional tees and with a removable golf ball support element wherein said aperture is sized to pass the stems of conventional tees and to engage the support element.

6. The base as in claim 1 also for use in a golf swing monitor teaching device, the device including a pair of sensing means for determining deviations in the trajectory of the golf club head during a swing from said preferred golf club head swing path, the base further comprising a pair of slots for slidingly mounting the pair of sensing means, each of said slots being oriented substantially perpendicular to said golf club head swing path and disposed on opposite sides of said path, and each of said slots permitting the respective sensing means to be moved toward or away from said path.

7. The base as in claim 6 wherein each of said slots is enlarged at its lower portion to define a T-shaped cross-section and provide abutment shoulders on said bottom surface.

8. A base as recited in claim 1 wherein the height of said bottom ribbing is graduated forwardly and rearwardly from said ball support means along said preferred swing path, the height of said bottom ribbing gradually decreasing away from said ball support means, said graduated height ribbing thereby providing said smoothly varying convex profile.

9. A resilient base for supporting a golf ball to be struck during the swinging movement of the head of a golf club, the base also for use in a golf swing monitor teaching device, the device including a pair of sensing means for determining deviations in the trajectory of the golf club head during a swing from a preferred golf club head swing path, the base comprising a top surface having ribbing oriented substantially parallel to the direction of the preferred golf club head swing path, said top ribbing providing a visual guide to the direction of the preferred golf club head swing path, the upper surface of said top ribbing forming a generally convex profile along said golf club head swing path; a bottom surface having ribbing oriented substantially perpendicular to said top ribbing to provide for engagement with the ground to inhibit the movement of the base when struck with a club head, said bottom ribbing and said top ribbing interacting to provide the desired resiliency; means for supporting the golf ball, said means being positioned in said golf club head swing path substantially at the point of maximum elevation on said convex profile, said support means including an aperture in the base at said support means position, the golf ball being supported by the shoulders of said aperture, said convex profile being provided by reducing the height of said bottom ribbing forwardly and rearwardly from said aperture; and a pair of slots for slidingly mounting the pair of sensing means, each of said slots being oriented substantially perpendicular to said golf club head swing path and disposed on opposite sides of said path, each of said slots permitting the respective sensing means to be moved toward or away from said path, each of said slots also being provided with an abutment shoulder on said bottom surface.

10. The base as in claim 9 also for use both with conventional tees and with a removable golf ball support element wherein the thickness of the base at the position of said aperture is such as to support a golf ball at a height above the ground approximately equal to that of a ball resting on the manicured turf of a fairway, and said aperture is sized to pass the stems of conventional tees and to engage the support element.

* * * * *